United States Patent [19]

Barksdale

[11] Patent Number: 4,934,117

[45] Date of Patent: Jun. 19, 1990

[54] PITCH POCKET AND METHOD OF FORMING SAME

[75] Inventor: Daniel L. Barksdale, Brownsburg, Ind.

[73] Assignee: Bridgestone/Firestone, Inc., Akron, Ohio

[21] Appl. No.: 451,070

[22] Filed: Dec. 15, 1989

[51] Int. Cl.[5] ..... E04D 13/14

[52] U.S. Cl. ..... 52/219; 52/199; 52/741; 285/42

[58] Field of Search ..... 52/58, 219, 199, 200, 52/741; 282/42–44

[56] References Cited

U.S. PATENT DOCUMENTS

| | | | |
|---|---|---|---|
| 2,985,465 | 5/1961 | Church | 285/43 X |
| 3,838,544 | 10/1974 | Hindall | 52/60 |
| 3,945,163 | 3/1976 | Nagler et al. | 52/219 |
| 4,010,578 | 3/1977 | Logsdon | 52/58 |
| 4,635,409 | 1/1987 | Vandemore | 52/60 |
| 4,664,390 | 5/1987 | Houseman | 52/58 X |
| 4,730,421 | 3/1988 | Leeland | 52/58 |

FOREIGN PATENT DOCUMENTS

| | | | |
|---|---|---|---|
| 615327 | 2/1961 | Canada | 52/199 |
| 640736 | 5/1962 | Canada | 285/43 |
| 1901745 | 8/1970 | Fed. Rep. of Germany | 285/42 |

OTHER PUBLICATIONS

Carlisle Sure-Seal Pourable Sealer Pocket Installation Procedures.

*Primary Examiner*—David A. Scherbel
*Assistant Examiner*—Lan Mai
*Attorney, Agent, or Firm*—Ronald Brietkrenz

[57] ABSTRACT

A pitch pocket construction and method of forming the same for sealing the junction between an element projecting upwardly from a roof and through an opening in a waterproof membrane covering the roof. A plastic ring of PVC is placed on the membrane surrounding the projecting member and a strip of uncured EPDM rubber flashing is secured to the outside surface of the ring and over the top edge thereof and forms an annular flange over the membrane surrounding the outside of the ring by an adhesive applied to these areas after placement of the ring on the membrane. The inside surface of the ring, the exterior surface of the projecting member, and the intervening membrane within the ring, then are coated with an adhesive. A reactive pourable waterproof sealant fills the area within the ring and is bonded by the adhesive to the inside surface of the ring, to the exterior surface of the projecting member, and to the intervening membrane to form a waterproof seal between the membrane and projecting member extending therethrough, and in combination with the rubber flashing securely fastens the ring to the membrane.

20 Claims, 4 Drawing Sheets

PITCH POCKET AND METHOD OF FORMING SAME

BACKGROUND OF THE INVENTION

1. Technical Field

The invention relates to a pitch pocket construction and method of forming the same for sealing the junction between an element projecting through an opening in a waterproof membrane covering a roof substrate to provide a waterproof seal therebetween. More particularly, the invention relates to such a pitch pocket and method which reduces penetration of the waterproof membrane by eliminating anchors or screws which normally hold the pocket in position and which reduces labor and material costs by simplifying the application and construction of the pitch pocket.

2. Background Information

It is common practice in the roof construction art to form a waterproof seal between the waterproof membrane which covers the roof substrate and various projecting members such as vent pipes, support straps, conduits, guide anchors and similar elements which extend upwardly from the roof and pierce the covering membrane. One type of structure commonly used is referred to as a pitch pocket or pan which surrounds the projecting element and which has a sealer which is poured into to pan to seal around the projecting element. Typically, the pitch pocket is made of metal or plastic and must be anchored through the waterproofing membrane into the supporting roof substrate, which due to these attachment anchors present other possible areas or openings in the membrane which are subject to leakage.

Therefore, it is desirable, in forming such pitch pockets, to reduce or eliminate penetration of the waterproofing membrane when installing the pitch pocket by eliminating any anchors or screws which normally hold the pocket in position, and to reduce the time and materials required for installing and forming the pitch pocket to reduce the cost of the roof installation.

Various types of pitch pocket, pans and associated devices have been proposed for achieving these results, examples of which are shown in the following patents.

U.S. Pat. No. 3,838,544, discloses a pitch pocket formed of a plurality of plastic corner units which are assembled into a rectangular configuration about conduits and projecting members and is secured to the roof by sheets of tar paper.

U.S. Pat. No. 3,945,163, discloses a plastic box having an integral lower flange which is covered by roofing material for securing it to the roof. A plurality of cup-shaped sections are formed in a top cover of the box for selective removal to receive projecting pipes of various diameters. A rubber boot is then held in place against the pipes by strap clamps to form a waterproof seal.

U.S. Pat. No. 4,635,409, discloses another pitch pocket having a rectangular shape formed by a plurality of plastic J-shaped sections which are interfitted with each other and secured to the roof by the same material as that used to cover the roof and an adhesive. The individual J-shaped members are secured together by fastening screws to form the desired size of pocket for receiving a filler material.

U.S. Pat. No. 4,730,421, discloses another pitch pocket for forming a seal around a projecting pipe wherein the box is formed of molded plastic. The box is placed around the pipe to be sealed and includes a base portion. A flashing is applied to the upper surface of the base and extends to the upper surface of the roof structure. The sheet material is an elastomeric and is cemented in place. When the box has been positioned, it is then filled with a filler material in the lower portion thereof surrounding the pipe, and then a roofing tar is used to complete the fill.

Another known sealer pocket construction consists of a strip of metal attached to a strip of an elastomer having a pressure sensitive adhesive applied thereto which is covered by a protective release paper. To form and install the sealer pocket, the release paper is removed and the metal band formed into a ring and placed about the projecting member. The elastomer sheeting forms a flange about the outside of the ring with the top portion of the rubber extending along the side of the formed metal ring. A pourable sealer then fills the area within the metal ring.

Although many of these prior pitch pockets and sealing constructions and methods may provide satisfactory results, they use metal which can rust and is difficult to form satisfactory, and most importantly, are considerably more expensive than certain plastic components and require the use of a relatively expensive strip of flashing and associated adhesive. Furthermore, these metal components can be sharp and cut or pierce the rubber membrane. Likewise, it may be difficult to achieve a good seal with the metal due to the non-compatibility of the adhesive or sealant between the metal and rubber components. Also, these prior methods require additional assembly steps, all of which increase the overall cost of the installation on a roof.

Therefore, the need exists for a pitch pocket and installation method which simplifies field application and which reduces the cost of materials, and which uses materials which have no limiting shelf life and will not rust or result in excess cracking over a length of time after being installed on a roof.

SUMMARY OF THE INVENTION

Objectives of the invention include providing an improved pitch pocket and installation method which utilizes inexpensive and readily available rings of various sizes and thicknesses of plastic material which are secured by a strip of uncured EPDM rubber flashing, which also is a very readily available and inexpensive material, and in which the rubber flashing secures the plastic ring to the waterproof membrane by a readily available adhesive, all of which avoid the use of any additional fasteners or anchors which pierce the membrane.

A further objective of the invention is to provide such an improved pitch pocket and installation method in which an adhesive bonds a pourable sealant to the inside surface of the plastic ring and to the projecting element, which in combination with the rubber flashing secures the plastic ring in position on the membrane, and in which such an adhesive is compatible with the plastic ring and sealant.

A still further objective of the invention is to provide such an improved pitch pocket and installation method in which the plastic ring can be maintained as an integral member and placed over a projecting element or can be cut at one location and spread apart to be placed around other types of projecting elements having no readily available end, and in which the rings can be provided in various diameters to correspond with the size of the projecting members to be sealed thereby.

Still another objective of the invention is to provide such an improved pitch pocket and installation method which eliminates premanufacture of the pockets and various materials used therefore, since the required components are readily available and can be transported easily to a job site and installed as required on a roof, and in which the various materials used are not concerned with shelf life or rapid deterioration if not used within a relatively short period of time on a roof installation.

These objectives and advantages are obtained by the improved pitch pocket of the invention, the general nature of which may be stated as a pitch pocket for sealing the junction between an element projecting through an opening in a waterproof membrane covering a roof substrate wherein said pocket includes a ring formed of a plastic material and having inner and outer annular surfaces and top and bottom peripheral edges, said ring surrounding the projecting element and supported on the covering membrane and providing a generally annular clearance area between an outer surface of the projecting element and the inner surface of said ring; a flashing strip of rubber secured to the outer surface and top edge of the ring by a first adhesive, and extending downwardly along an upper portion of the inner surface, and forming a flange extending about the outer surface said ring, with said flange being secured to the membrane by said first adhesive; a second adhesive covering the inside surface of the ring, the membrane within the clearance area, and a portion of the outer surface of the projecting element; and a reactive waterproof sealant filling the clearance area and extending between the inner surface of the ring and exterior surface of the projecting member and projecting above the top peripheral edge of said ring, and being secured to said ring, membrane and projecting member by said second adhesive.

These objectives and advantages are further achieved by the improved method of the invention, the general nature of which may be stated as including a method of creating a pitch pocket for sealing the junction between an element projecting through an opening in a waterproof membrane covering a roof substrate, including the steps of placing a plastic ring on the membrane in a surrounding spaced relationship with respect to the projecting member; applying a first adhesive to an outer surface and a top edge of the ring and to an area of the membrane extending about the outside of said ring; securing a strip of rubber flashing to the outside surface and top edge of the ring and to the adhesive coated area of the membrane surrounding the ring by said first adhesive; applying a second adhesive to the membrane located within the ring and to an inside surface of the ring and to an exterior surface of the projecting member; and pouring a reactive sealant into the interior of the ring and filling the area between the ring and projecting member, so that said sealant upon curing is sealed by the second adhesive to the inside surface of the ring, adjacent membrane and exterior of the projecting member to form a waterproof seal for the junction of said projecting member and membrane.

BRIEF DESCRIPTION OF THE DRAWINGS

A preferred embodiment of the invention, illustrative of the best mode in which applicant has contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 1:
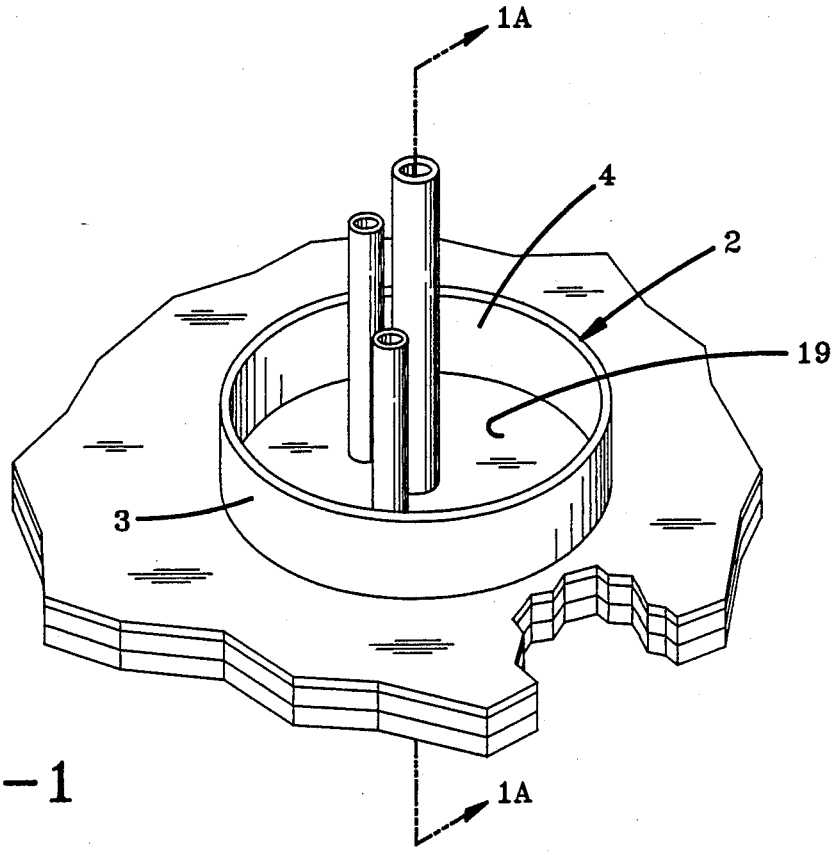
FIG. 1 is a perspective view showing the first step of the improved method and formation of the pitch pocket wherein a plastic ring is placed on a waterproof membrane surrounding a projecting element.

The improved pitch pocket construction of an invention is indicated generally at 1, and is shown in final configuration in 4. The particular method for forming pitch pocket 1 is shown generally diagrammatically in FIGS. 1–4, and is described in greater detail below.

Pitch pocket 1 includes a ring indicated generally at 2, preferably formed as an integral one-piece member. Ring 2 is formed of a plastic material such as PVC or ABS and has outer and inner annular surfaces 3 and 4, respectively, and top and bottom edges 5 and 6, respectively. Although plastic is the preferred material of ring 2, other types of synothic, non-metallic material can be used.

A typical roof installation in which improved pitch pocket 1 will be utilized includes a roof substrate comprised of a wood deck 8 which is covered by sheets of insulation 9 over which has been applied a waterproof rubber membrane 10 which is secured to insulation 9 and wood deck 8 by a variety of mechanical fasteners or adhesives, all of which are well known in the art. Membrane 10 in the preferred embodiment, is a cured EPDM rubber.

A plurality of projecting members or elements indicated at 12, which are illustrated in the drawings as being cylindrical pipes, project through aligned openings 14 and 15 formed in wood deck 8 and insulation 9 (FIG. 1A) and extend through an aligned opening 16 formed in membrane 10. Projecting element 12 is shown and referred to as pipe 12 although it is easily understood that pitch pocket 1 may be used with other types of projecting elements such as conduits, vent pipes, or the like readily present on a roof of the type using waterproof membrane 10.

Figure 1A:
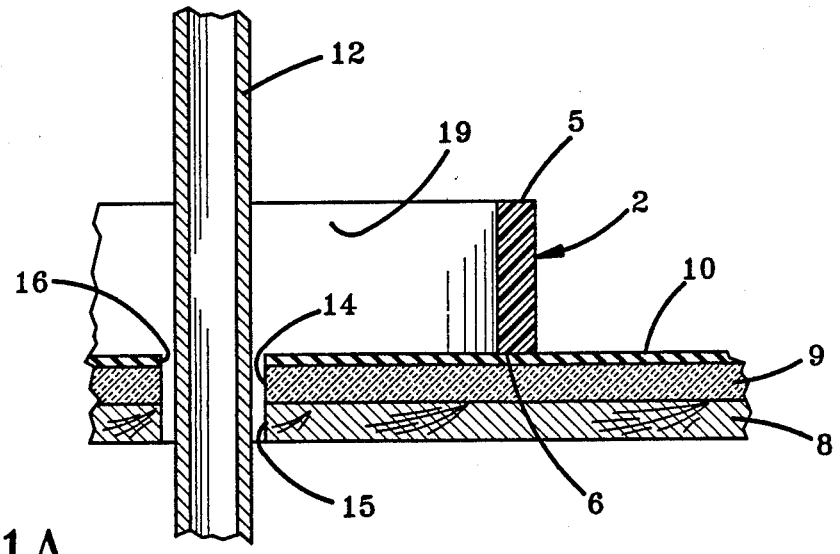
FIG. 1A is an enlarged fragmentary sectional view taken on line 1A—1A of FIG. 1.

At the start of assembly of pitch pocket 1, an appropriate sized diameter ring 2 is placed over the top ends 18 of pipes 12 with bottom edge 6 of ring 2 resting on membrane 10 as shown in FIG. 1A. Inner surface 4 is generally uniformly spaced about pipe 12 forming a generally annular space 19 between ring 2 and pipe 12.

Next, an adhesive 20 (FIG. 2A) is applied to outer surface 3, top edge 5 and along an upper portion 17 of inner surface 4 of ring 2, and over a generally annular area 21 of membrane 10 surrounding ring 2. Adhesive 20 is of a usual type used in roof installations, a variety of which are readily available in the rubber roof membrane art.

Figure 2:
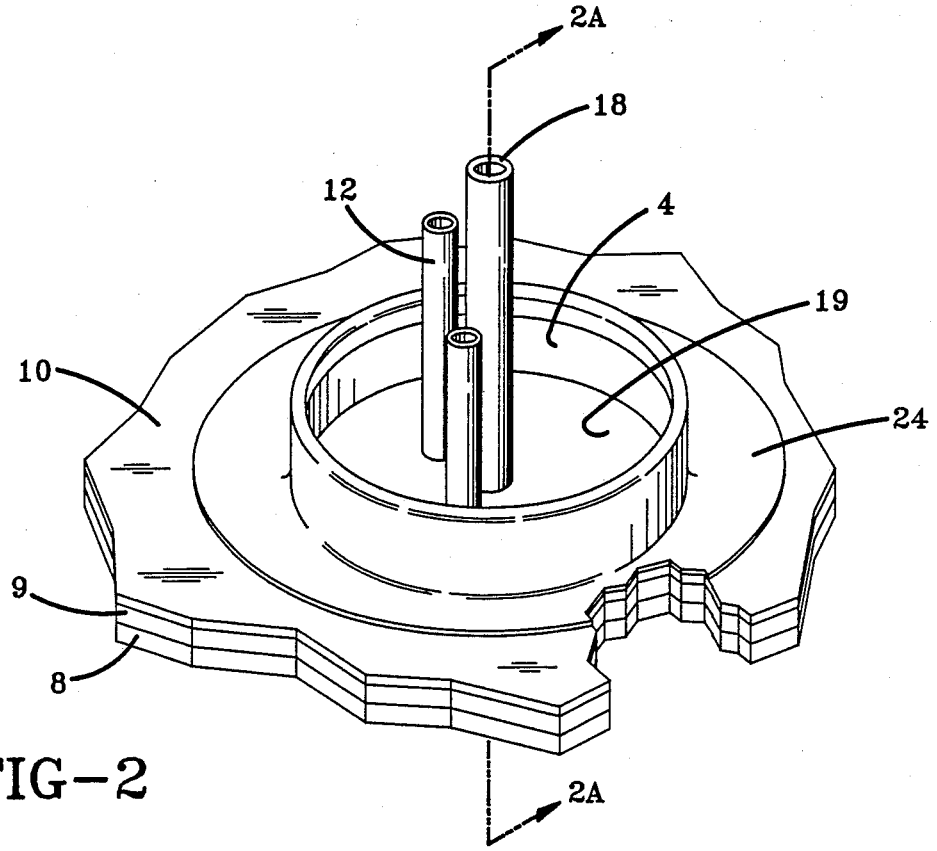
FIG. 2 is a perspective view similar to FIG. 1 showing the next step of the improved method wherein a rubber flashing strip is secured to the outside of the plastic ring and forms the annular surrounding flange by a first adhesive.
Figure 2A:
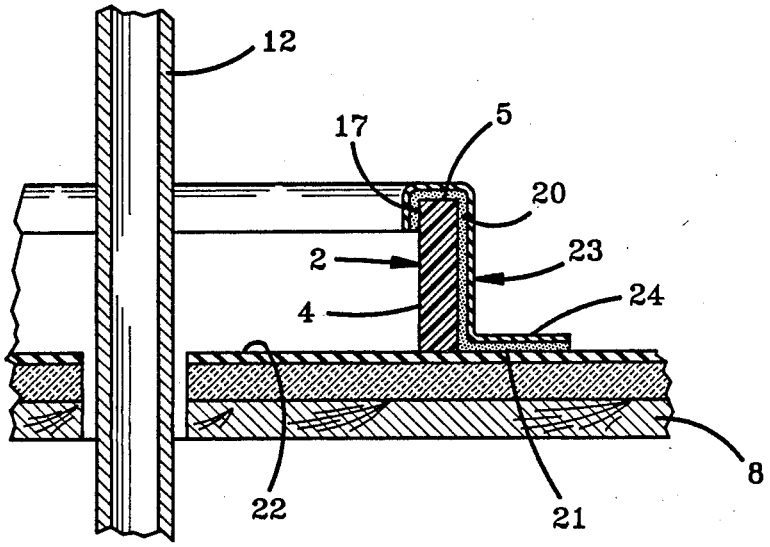
FIG. 2A is an enlarged fragmentary sectional view taken on line 2A—2A of FIG. 2.

Next, a strip of rubber flashing indicated generally at 23, preferably formed of uncured EPDM, is secured as shown in FIGS. 2 and 2A by adhesive 20 along outer ring surface 3, along top ring edge 5 and partially along upper portion 17 of inner ring surface 4. Flashing 23 forms a generally annular flange 24 surrounding ring 2 where it is secured to annular area 21 of membrane 10. Thus, rubber flashing 23 positions and secures ring 2 on membrane 10 without using any mechanical fasteners or other devices which require anchoring to the projecting member or penetrating through the membrane and into the roof substrate.

Figure 3:
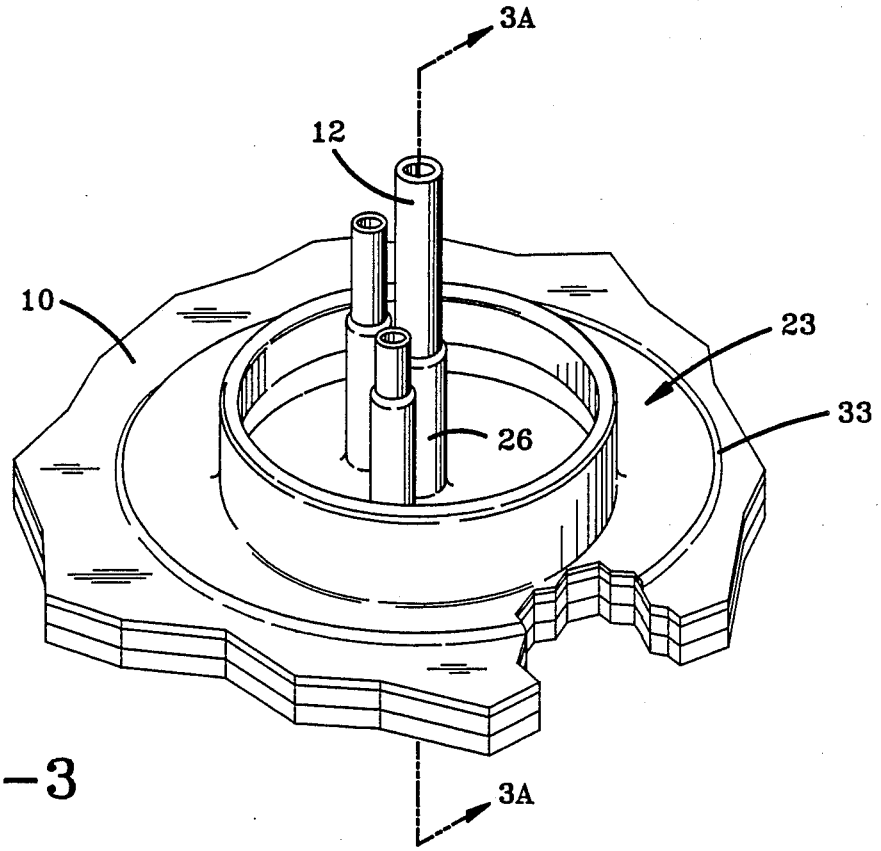
FIG. 3 is a perspective view similar to FIGS. 1 and 2 showing the next step of the improved method wherein the inside of the plastic ring, adjacent membrane and surface of the projecting elements are covered with adhesive.
Figure 3A:
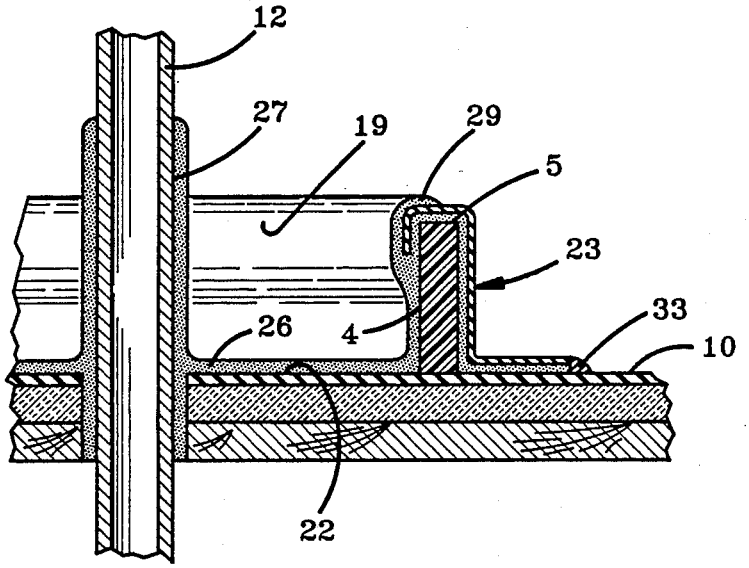
FIG. 3A an enlarged fragmentary sectional view taken on line 3A—3A of FIG. 3.

Referring to FIG. 3 and 3A, the next step of the improved method includes applying a second adhesive 26, which preferably is the same as adhesive 20, to the remainder of inner surface 4 of ring 2 and covering an annular area 22 of membrane 10 formed within annular space 19, and along outer surface 27 of pipe 12. Adhesive 26 also may fill in the annular opening 16 of membrane 10 surrounding pipe 12. Since adhesive 26 preferably is the same as adhesive 20, it also is a readily available inexpensive material which has been proven satisfactory in the roof installation art. Preferably, adhesive 26 will extend along a portion 29 of rubber flashing 23 which extends along top ring edge 5.

Figure 4:
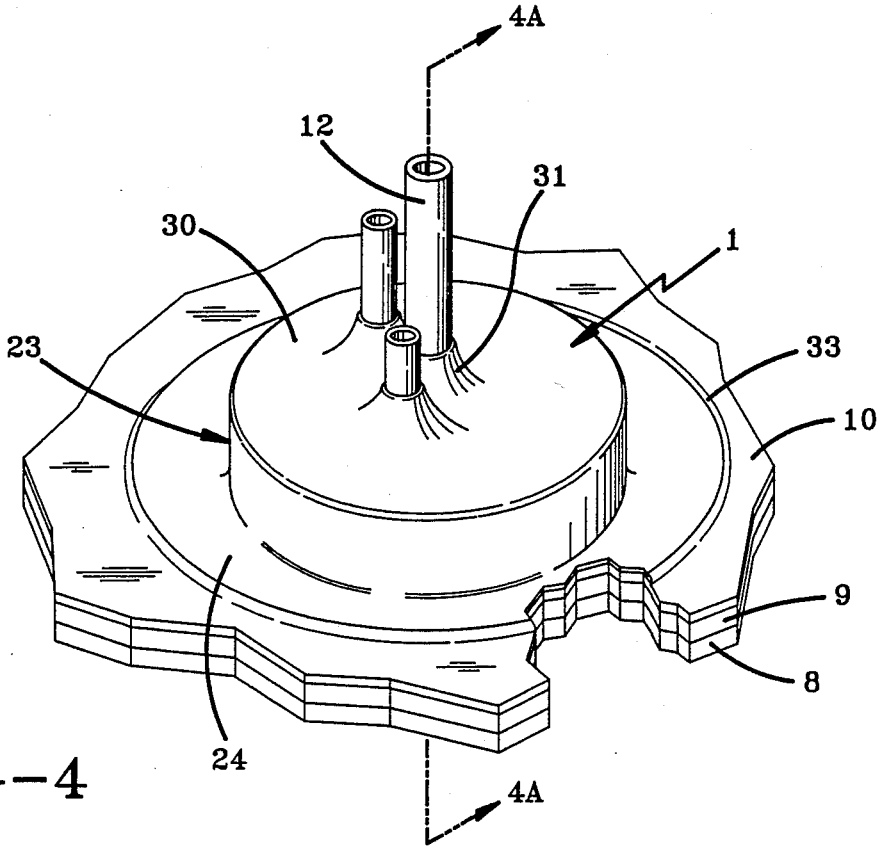
FIG. 4 is another perspective view showing the finished pitch pocket construction in which the interior of the ring is filled with a waterproof sealant.
Figure 4A:
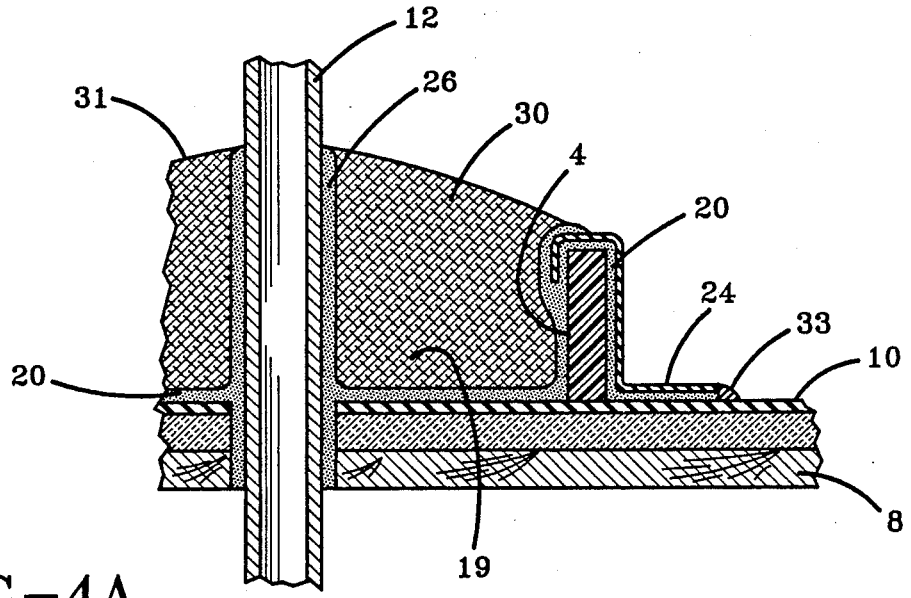
FIG. 4A an enlarged fragmentary sectional view taken on line 4A—4A of FIG. 4.

Next, a reactive waterproof sealant 30 is mixed on site by a two-part reactive combination and is poured into the annular space 19 between the interior of ring 2 and exterior of pipe 12 as shown in FIG. 4A. Preferably, sealant 30 will be generally pourable although not sufficiently fluid to be freeflowing, whereby a dome-shaped configuration can be formed with the apex 31 thereof surrounding pipe 12.

In accordance with one of the features of the invention, adhesive 26 will firmly bond sealant 30 to the outer surface of the pipe 12, to inner surface 4 of ring, and to the intervening membrane 10 in annular area 22 completely sealing the junction formed between the exterior of pipe 12 and opening 16 of membrane 10 through which pipe 12 extends. Adhesive 26 is compatible with sealant 30, with the inner surface of ring 2 and with membrane 10 to form a strong bond therebetween, and in combination with rubber flashing 23 securely holds ring 2 in position on membrane 10 to form a rigid bond between sealant 30 and the outer surface of pipe 12. This dome-shaped configuration provides for water run-off preventing water from pooling around pipe 12 to ensure that the formed junction seal remains waterproof.

Finally, if desired, a bead 33 of rubber caulking is applied about the periphery of rubber flashing 23 and membrane 10 (FIGS. 3A and 4A) to further ensure a complete seal for pipe 12.

When ring 2 is used with a projecting element 12 that does not have a readily available top end 18 as pipe 12 described above, ring 2 can be split at one location on its circumference and spread sufficiently apart enabling the ring to be placed around a generally continuance projecting element without affecting the concept of the invention or the resulting pitch pocket formed thereby. Such ring splitting may be necessary for a number of projecting elements on a typical roof installation but presents no problem to the installation of the pitch pocket since the plastic is readily separated by a hacksaw or other sharp instrument, and the plastic material contains sufficient flexibility enabling it to be spread apart permitting the projecting member to pass through the spread opening formed therein. The ring then will return to its normal closed position after passage of the projecting element therethrough.

Ring 2 being formed of plastic provides an extremely inexpensive and available component since it is the type of plastic used for usual plumbing pipe and can be carried to the job site in various diameters and lengths of pipe and cut to the desired length directly at the site. In the preferred embodiment, ring 2 will have a height of approximately 2 inches and a thickness between $\frac{1}{8}$ and $\frac{1}{4}$ inches. Likewise, in the preferred embodiment, rubber flashing 23 will have a width of approximately $5\frac{1}{2}$ inches providing for annular flange 24 to have a width of approximately 3 inches with the remaining $\frac{1}{2}$ inch extending along top ring edge 5 and along upper portion 17 of inner ring surface 4. However, these dimensions can vary without affecting the concept of the invention. Furthermore, ring 2 is held in a rigid position by the combination of rubber flashing 23 and the bonding of sealant 30 to the inner ring surface, to the intervening membrane, and to the outer surface of pipe 12 by adhesive 26.

Likewise, the forming of rubber flashing 23 of uncured EPDM also provides a readily available extremely inexpensive material which can be cut from large sheets of such material, either prior to transportation to the job site or on the job site, and which is applied easily by adhesive 20 requiring no substantial prior preparation. Adhesive 20 and 26 preferably are similar requiring only a single adhesive to be transported to the job site and also is a readily available inexpensive field proven component, requiring no prepreparation or assembly.

One type of adhesive found satisfactory is distributed by Bridgestone/Firestone, Inc. under its designation SA 1065 Splice Adhesive, and is a butyl based adhesive.

Sealant 30 also is a readily available component and preferably is a two-part reactive polyurethane which forms a solid when curing after exposure to the atmosphere over a relatively short period of time. One type of sealant 30 found suitable is manufactured and distributed by BRIDGESTONE/FIRESTONE, INC. and designated as its product S10 Two-Part Pourable Sealer, and identified by its part number W 563587065. However, other types of sealants can be used without affecting the concept of the invention. Caulking bead 33, likewise, can be of various materials readily available in the roof installation art and can be applied by a caulking gun, hand tool or other device.

As can be seen from the drawings and above description, there are no metal parts or additional fasteners required for forming pitch pocket 1 which are subject to rust and corrosion after periods of use, and that the components are plastic or rubber which are relatively unaffected by the harsh environments to which most roof installations are exposed, and that they require no preformed procedures and are extremely inexpensive and readily available components, thereby, providing a pitch pocket and installation method which is believed to be considerably less expensive and easier to install and is as equally efficient as known prior pitch pocket and installation methods.

Accordingly, the improved pitch pocket and installation method is simplified, provides an effective, safe, inexpensive, and efficient device and method which achieves all the enumerated objectives, provides for eliminating difficulties encountered with prior devices and methods, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved pitch pocket and installation method is constructed and used, the characteristics of the construction and method, and the advantageous, new and useful results obtained; the new and useful structures, devices, elements, arrangements, parts and combinations, and method steps, are set forth in the appended claims.

What is claimed is:

1. A pitch pocket for sealing the junction between an element projecting through an opening in a waterproof membrane covering a roof substrate, said pocket including:

(a) a ring formed of a nonmetallic plastic material and having inner and outer annular surfaces and top and bottom peripheral edges, said ring surrounding the projecting element and supported on the covering membrane and providing a generally annular clearance space between an outer surface of the projecting element and the inner surface of said ring;

(b) a flashing strip of rubber secured to the outer surface and top edge of the ring by a first adhesive and extending downwardly along an upper portion of the inner surface, and forming a flange extending about the outer surface of said ring, with said flange being secured to the membrane by said first adhesive;

(c) a second adhesive covering the inside surface of the ring, the membrane within the clearance space, and a portion of the outer surface of the projecting element; and (d) a reactive waterproof sealant filling the clearance space and extending between the inner surface of the ring and exterior surface of the projecting element and projecting above the top peripheral edge of said ring, and being secured to said ring, membrane and projecting element by said second adhesive.

2. The pitch pocket defined in claim 1 in which the ring is formed of PVC or ABS plastic.

3. The pitch pocket defined in claim 1 in which the membrane is cured EPDM.

4. The pitch pocket defined in claim 1 in which the sealant is a two part reactive polyurethane; and in which said sealant is fluid when filling the clearance space and subsequently hardens upon curing when exposed to the atmosphere.

5. The pitch pocket defined in claim 1 in which the ring has a height of approximately 2 inches and a thickness of approximately $\frac{1}{8}$ to $\frac{1}{4}$ inches.

6. The pitch pocket defined in claim 1 in which a bead of rubber caulking extends about a junction of the membrane and an outer edge of the flange of the rubber flashing strip.

7. The pitch pocket defined in claim 1 in which the rubber flashing strip which extends downwardly along the upper portion of the inner surface of the ring is secured to the ring by the first adhesive.

8. The pitch pocket defined in claim 1 in which the flashing strip is formed of uncured EPDM.

9. The pitch pocket defined in claim 1 in which the waterproof sealant has a generally dome-shaped configuration about the projecting element.

10. A method of creating a pitch pocket for sealing the junction between an element projecting through an opening in a waterproof membrane covering a roof substrate of a roof including the steps of:

(a) placing a nonmetallic ring on the membrane in a surrounding spaced relationship with respect to the projecting element;

(b) applying a first adhesive to an outer surface and a top edge of the ring and to an area of the membrane extending about the outer surface of said ring;

(c) securing a strip of rubber flashing to the outer surface and top edge of the ring and to the adhesive coated area of the membrane surrounding the ring by said first adhesive;

(d) applying a second adhesive to the membrane located within the ring and to an inner surface of the ring and to an exterior surface of the projecting element; and (e) pouring a reactive uncured sealant into the interior of the ring and filling the area between the ring and projecting element, so that said sealant upon curing is secured by the second adhesive to the inner surface of the ring, adjacent membrane and exterior of the projecting element to form a waterproof seal for the junction of said projecting element and membrane.

11. The method defined in claim 10 including the steps of applying the first adhesive to an upper portion of the inner surface of the ring adjacent the top edge; and turning the strip of rubber flushing over the top edge and along said upper portion of the inner surface.

12. The method defined in claim 10 including the step of filling the junction between the projecting element and membrane with the second adhesive.

13. The method defined in claim 10 including the step of applying a bead of rubber caulking at a junction of the membrane and an edge of the strip of rubber flashing secured thereto by the first adhesive outside of the ring.

14. The method defined in claim 10 including the step of forming the pourable sealant into a dome-shaped configuration with the apex thereof surrounding the projecting element.

15. The method defined in claim 10 including the step of splitting the ring at one location on its circumference and expanding said ring outwardly sufficiently to enable the projecting element to pass through said split when placing the ring in a spaced relationship about said projecting element.

16. The method defined in claim 10 including the steps of maintaining the ring as a continuous one-piece member, and placing the ring over an upper end of the projecting element when placing the ring on the membrane.

17. The method defined in claim 11 including the step of forming the sealant over the turned portion of the rubber flashing at the top edge of the ring.

18. The method defined in claim 10 in which the rubber flashing is uncured EPDM.

19. The method defined in claim 10 in which the membrane is cured EPDM.

20. The method defined in claim 10 in which the ring is of a plastic material.

* * * * *

UNITED STATES PATENT AND TRADEMARK OFFICE

CERTIFICATE OF CORRECTION

PATENT NO. : 4,934,117

DATED : June 19, 1990

INVENTOR(S) : Daniel L. Barksdale

It is certified that error appears in the above-identified patent and that said Letters Patent is hereby corrected as shown below:

Column 4, line 22

"3A an" should read -- 3A is an --

Column 4, line 27

"4A an" should read -- 4A is an --

Column 5, line 47

"of ring," should read -- of ring 2, --

Signed and Sealed this

Second Day of June, 1992

*Attest:*

DOUGLAS B. COMER

*Attesting Officer*

*Acting Commissioner of Patents and Trademarks*